United States Patent [19]

Masghati

[11] Patent Number: 4,555,112

[45] Date of Patent: Nov. 26, 1985

[54] GOLF CLUB SHAFTS WITH MATCHED FREQUENCIES OF VIBRATION

[75] Inventor: Mohammad Masghati, Addison, Ill.

[73] Assignee: Wilson Sporting Goods Company, River Grove, Ill.

[21] Appl. No.: 534,809

[22] Filed: Sep. 22, 1983

[51] Int. Cl.[4] ..... A63B 53/12

[52] U.S. Cl. ..... 273/77 A; 273/80 B

[58] Field of Search ..... 273/77 A, 80 B, 80 R, 273/80 A, 80 C, 80 D

[56] References Cited

U.S. PATENT DOCUMENTS

| | | | |
|---|---|---|---|
| 2,250,441 | 7/1941 | Vickery | 273/77 A |
| 4,070,022 | 1/1978 | Braly | 273/77 A |
| 4,122,593 | 10/1978 | Braly | 273/77 A X |

FOREIGN PATENT DOCUMENTS

| | | | |
|---|---|---|---|
| 1286255 | 8/1972 | United Kingdom | 273/77 A |
| 1598548 | 9/1981 | United Kingdom | 273/77 A |

*Primary Examiner*—George J. Marlo

[57] ABSTRACT

A set of golf club shafts for a set of golf clubs is made so that the natural frequencies of vibration of the shaft for the various clubs are matched. Each of the shafts includes a butt portion, a tip portion, and a plurality of stepped portions between the butt portion and the tip portion. The length of the butt portion, the length of the tip portion, and the length of all of the stepped portions except one is the same for all of the shafts. The length of said one stepped portion of each shaft is selected to provide the shaft with the desired natural frequency of vibration, and the difference in the overall length of two shafts corresponds to the difference in the lengths of said one stepped portion of the two shafts. The torsional resistance of each shaft is increased without increasing the weight of the shaft by providing a shaft with relatively large inside and outside diameters and a relatively small thickness.

8 Claims, 14 Drawing Figures

SHAFT A

SHAFT B

R FLEX IRON SHAFTS

| IRON | A | B | C | WEIGHT (oz.) |
|---|---|---|---|---|
| 1 | 39.000 | 5.000 | 19.500 | 4.190 |
| 2 | 38.500 | 4.500 | 19.250 | 4.150 |
| 3 | 38.000 | 4.000 | 19.000 | 4.110 |
| 4 | 37.500 | 3.500 | 18.750 | 4.070 |
| 5 | 37.000 | 3.000 | 18.500 | 4.030 |
| 6 | 36.500 | 2.500 | 18.250 | 3.990 |
| 7 | 36.000 | 2.000 | 18.000 | 3.950 |
| 8 | 35.500 | 1.500 | 17.750 | 3.910 |
| 9 | 35.000 | 1.000 | 17.500 | 3.870 |
| TOL. | ±0.125 | ±0.010 | ±0.250 | ±0.125 |

S FLEX IRON SHAFTS

| IRON | A | B | C | WEIGHT |
|---|---|---|---|---|
| 1 | 39.000 | 6.600 | 19.625 | 4.380 |
| 2 | 38.500 | 5.500 | 19.375 | 4.340 |
| 3 | 38.000 | 5.000 | 19.125 | 4.300 |
| 4 | 37.500 | 4.500 | 18.875 | 4.260 |
| 5 | 37.000 | 4.000 | 18.625 | 4.220 |
| 6 | 36.500 | 3.500 | 18.375 | 4.180 |
| 7 | 36.000 | 3.000 | 18.125 | 4.140 |
| 8 | 35.500 | 2.500 | 17.875 | 4.100 |
| 9 | 35.000 | 2.000 | 17.625 | 4.060 |
| 10 | 34.500 | 1.500 | 17.375 | 4.020 |
| TOL. | ±0.125 | ±0.010 | ±0.250 | ±0.125 |

GOLF CLUB SHAFTS WITH MATCHED FREQUENCIES OF VIBRATION

BACKGROUND AND SUMMARY

This invention relates to golf club shafts, and, more particularly, to a set of golf club shafts having matched natural frequencies of vibration.

The concept of frequency matching golf club shafts is well known, but the methods by which shafts are frequency matched differ. For example, U.S. Pat. No. 3,871,649 describes matching the frequencies of golf club shafts so that the frequency of each shaft is the same. This is accomplished either by using a different wall thickness for each shaft in the set or by varying the lengths of the butt portion and the tip portion of each shaft in the set.

U.S. Pat. No. 4,070,022 describes matching the frequencies of golf club shafts so that a plot of frequency versus shaft length falls along a predetermined gradient. No specific method of achieving frequency matching is described in the patent.

U.S. Pat. No. 4,122,593 describes a method of achieving the frequency matching of U.S. Pat. No. 4,070,022 by removing selected amounts from the butt portion and the tip portion of each shaft.

In accordance with the invention, the frequency of vibration of a set of golf club shafts is matched by varying the length of only one of the stepped portions of each shaft. The length of the remaining stepped portions, the length of the butt portion, and the length of the tip portion remain constant throughout the set. The difference in length of any two shafts corresponds to the difference in length of said one stepped portion of the two shafts. The torsional resistance of the shafts is increased without increasing the weight of the shafts by providing the shafts with relatively large inside and outside diameters and relatively small thicknesses.

DESCRIPTION OF THE DRAWING

The invention will be explained in conjunction with an illustrative embodiment shown in the accompanying drawing in which.

DESCRIPTION OF SPECIFIC EMBODIMENTS

Figure 1:
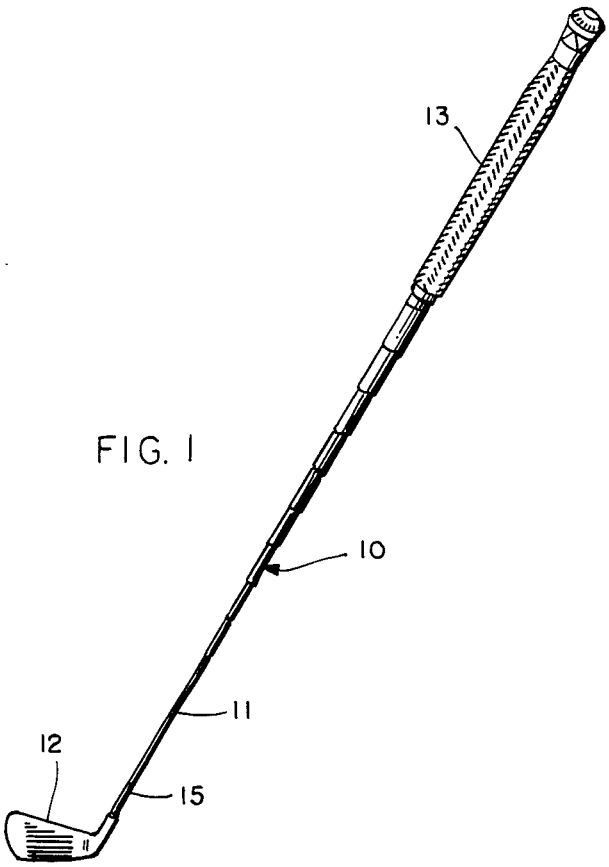
FIG. 1 is a perspective view of a golf club equipped with a golf club shaft formed in accordance with the invention.
Figure 2:
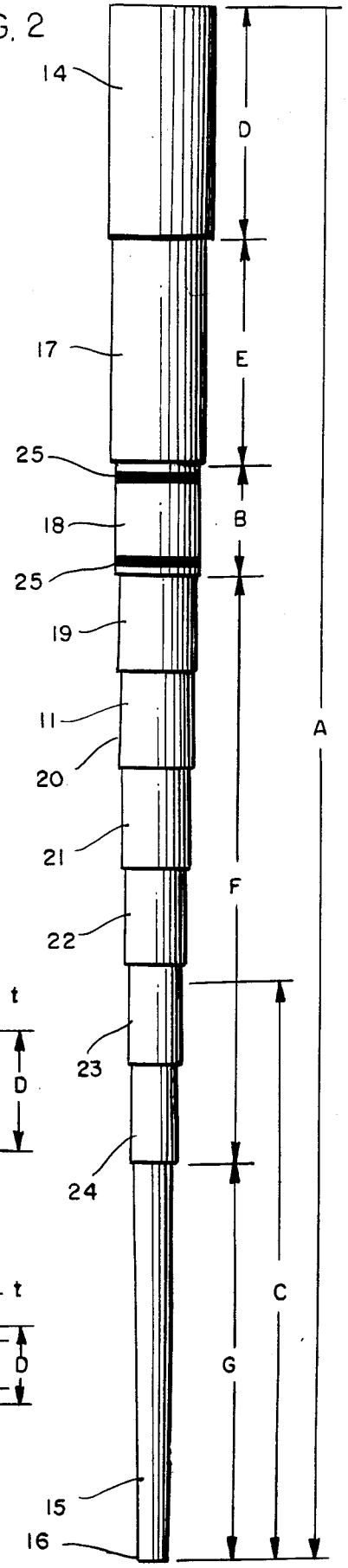
FIG. 2 is a plan view of a golf club shaft formed in accordance with the invention.

Referring to FIGS. 1 and 2, a golf club 10 includes a tubular shaft 11 and a clubhead 12. A grip 13 is mounted on the butt portion 14 (FIG. 2) of the shaft, and the clubhead is mounted on the tip portion 15.

The shaft is formed in a conventional stepped configuration. The butt portion 14 has the largest diameter, and the tip portion 15 has the smallest diameter and tapers toward the tip end 16. Eight stepped portions 17, 18, 19, 20, 21, 22, 23, and 24 of progressively reduced diameters are located between the butt portion and the tip portion.

Figures 3, 4, 5:
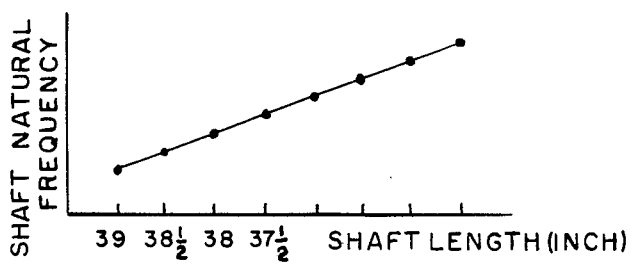
FIG. 3 is a table of dimensions and weights of a set of iron club shafts having regular flex.
FIG. 4 is a table of dimensions and weights of a set of iron club shafts having stiff flex.
FIG. 5 is a graph illustrating the frequencies of vibration of a set of shafts as a function of length.
Figure 10:
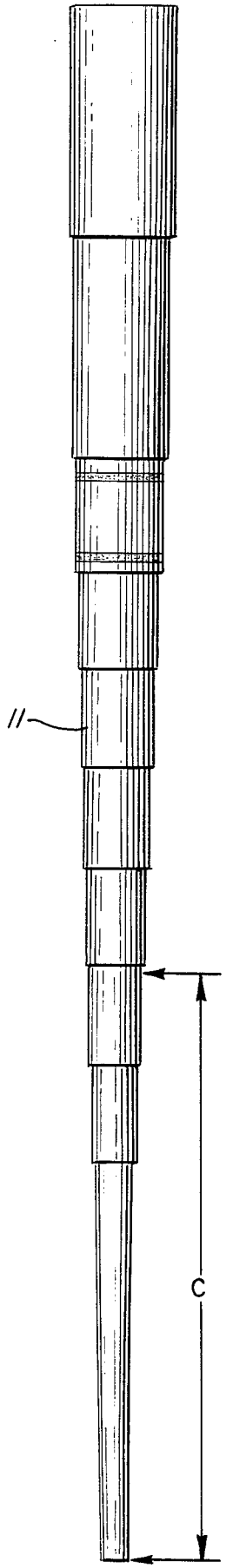
FIG. 10 illustrates the balance point of the shaft.
Figure 11:
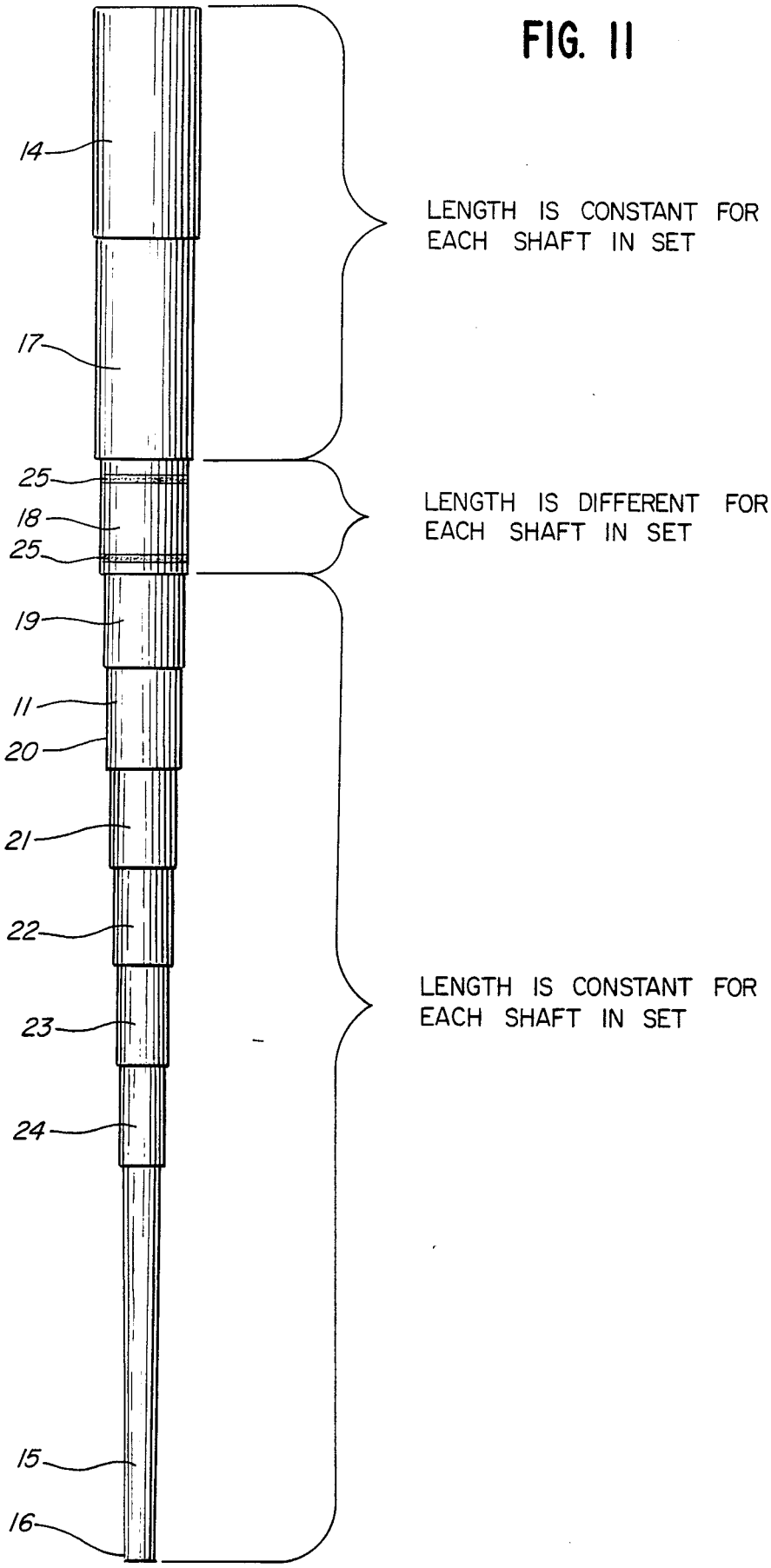
FIGS. 11–14 illustrate various physical characteristics of the shafts.
Figure 12:
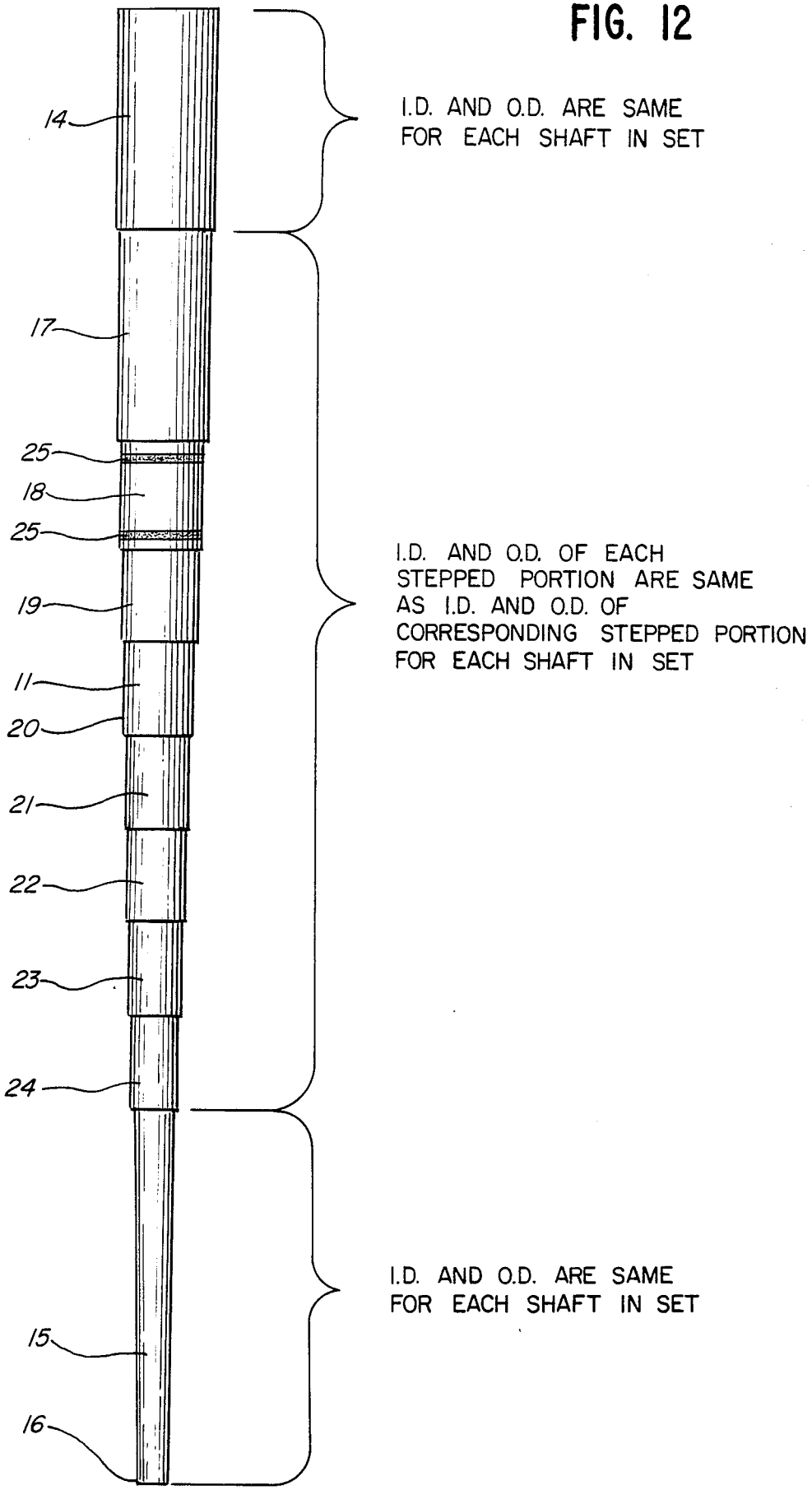
Figure 13:
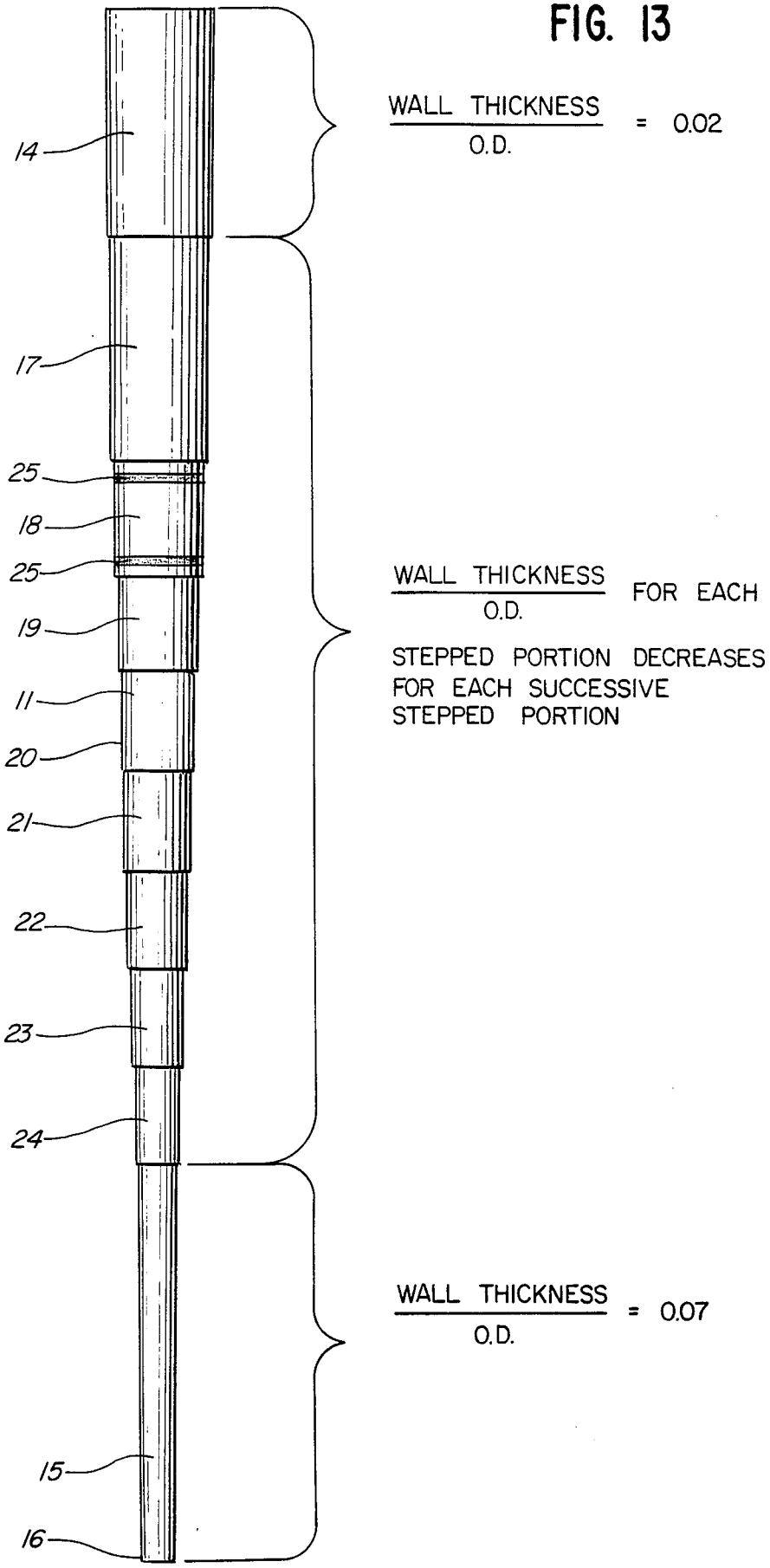
Figure 14:
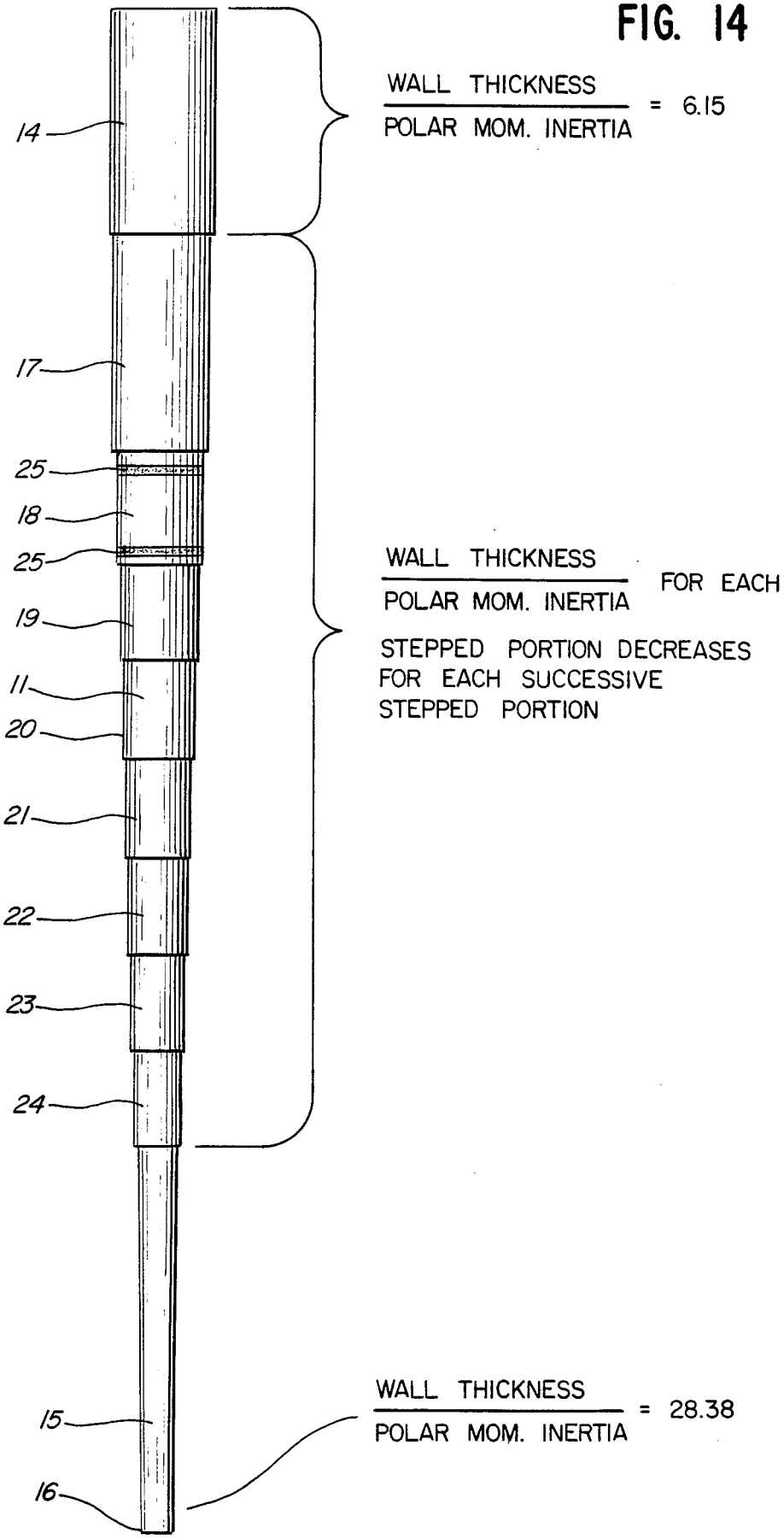

The shaft illustrated in FIG. 2 is for an iron golf club, and a plurality of shafts of varying lengths are provided for a set of iron clubs. Referring to FIG. 3, the standard length of a shaft for a 1 iron is 39 inches, and the length of the shaft conventionally decreases by ½ inch for each successively numbered club.

The length, the inside and outside diameters, and the wall thickness of the butt portion 14 of each of the shafts of the set are the same. The length of the butt portion is the dimension D in FIG. 2, and for the set of regular flex iron shafts represented by FIG. 3 the dimension D was 5.000 inches for each shaft.

Similarly, the length, the inside and outside diameters, and the wall thickness of the tip portion 15 of each of the shafts of the set are the same. The length of the tip portion is the dimension G in FIG. 2, and for the set of regular flex iron shafts represented by FIG. 3 the dimension G was 10.000 inches for each shaft.

The length B of the stepped portion 18 varies for each shaft of the set, but the length of each of the other stepped portions 17 and 19–24 remains constant throughout the set. The inside and outside diameters and the thickness of each of the stepped portions remains constant throughout the set. For the set of shafts represented in FIG. 3, the length E of the stepped portion 17 was 6.250 inches for each shaft in the set, and the length of each of the stepped portions 19–24 was 2.125 inches for each shaft in the set. The total length F of the 6 stepped portions 19–24 was therefore 12.750 inches.

As shown in FIG. 3, the overall length A of the shafts of the set varies from 39.000 inches for the 1 iron to 35.000 inches for the 9 iron. The length, diameters, and wall thickness of each of the portions 14–24 of each shaft of the set are constant throughout the set except for the stepped portion 18, which is indicated on the shaft by two epoxy stripes 25. Accordingly, the weight and stiffness of the portions of the shaft represented by the dimensions D, E, F and G are the same for all shafts of the set.

The inside and outside diameters and the wall thickness of the stepped portion 18 of the shafts are constant, but the length of this stepped portion varies for each shaft of the set. The change in length of the stepped portion 18 changes the stiffness and the natural frequency of each shaft. The dimension B of the stepped portion of each shaft in the set is listed in FIG. 3, and this dimension decreases uniformly by ½ inch for each numbered shaft from 5.000 inches for the 1 iron to 1.000 inch for the 9 iron. Since the length of the other portions of the shafts remains constant, the change in the overall length of the shaft is the same as the change in the dimension B of the stepped portion 18. Since the change in length of each successive shaft is uniform throughout the set, the change in the natural frequency of each successive shaft will also be uniform throughout the set.

The natural frequency of the shafts is plotted against the length of the shafts in FIG. 5. The uniform change in frequency is indicated by a substantially straight line.

In one specific set of shafts the natural frequencies of the shafts for the 1 iron through 9 iron were as follows:

| Club No. | Frequency (Cycles Per Minute) |
|---|---|
| 1 | 325 |
| 2 | 328 |
| 3 | 331 |
| 4. | 333½ |
| 5 | 335 |
| 6 | 338 |
| 7 | 340 |
| 8 | 343 |
| 9 | 345 |

The change in the dimension B of the shaft also varies the weights of the shaft as indicated in FIG. 3. The weight varies from 4.190 ounces for the 1 iron shaft to 3.870 ounces for the 9 iron shaft.

The balance point of the shaft is represented by the dimension C in FIG. 2. The change in the length of the stepped portion 18 changes the position of the balance point as indicated in FIG. 3.

The outside diameter of the butt portion 14 of each of the shafts represented by FIG. 3 is 0.600 inches. The outside diameters of the stepped portions 17–24 decrease progressively as follows: 0.585, 0.575, 0.550, 0.525, 0.500, 0.475, 0.450, and 0.425 inch. The end portion 15 of each of the shafts represented by FIG. 3 has a taper of 0.0075 T.P.I. and tapers from a maximum outside diameter of 0.400 inch to a diameter of 0.355 inch at the tip end 16.

The tolerances for each of the dimensions A, B, and C and the weights are indicated at the bottom of FIG. 3. The tolerance of the other of the foregoing dimensions is ±0.005 except for the outside diameter of the butt portion and the outside diameter of the tip end 16, which have a tolerance of ±0.002.

The dimensions for a set of stiff flex iron shafts are shown in FIG. 4. Again, the only portion of the shaft which varies is the length B of the stepped portion 18. The length, diameters, and wall thickness of each of the other portions of the shaft remain constant throughout the set.

The length of the tip portion 15 of the stiff flex iron shafts is 9.000 inches as compared to 10.000 inches for the regular flex iron shafts. The lengths of the butt portion 14 and the stepped portions 17 and 18–24 of the stiff flex shafts are the same as for the regular flex shafts. The outside diameters of the butt portion, the stepped portions, and the tip portion are the same as for the set of regular flex iron shafts.

The natural frequencies of shafts for wood clubs can be matched in the same manner. Shafts for a set of wood clubs had a stepped configuration similar to the shaft shown in FIG. 2, but the wood shafts had ten stepped portions rather than eight. The length of the variable length stepped portion (corresponding to the stepped portion 18 in FIG. 2) for regular flex wood shafts decreased ½ inch for each shaft from 5.000 inches for the driver to 2.500 inches for the 6 wood. The change in length of the variable length stepped portion changed the overall length of each successive shaft by ½ inch from 44 inches for the driver to 41.500 inches for the 6 wood. The natural frequencies of the shafts varied uniformly from one shaft to the next.

Similarly, in a set of stiff flex shafts for wood clubs the length of the variable stepped portion decreased ½ inch for each successive shaft from 6.000 inches for the driver to 3.500 inches for the 6 wood. The overall length of the shafts likewise decreased ½ inch for each successive shaft from 44.000 inches for the driver to 41.500 inches for the 6 wood. The natural frequencies of the shafts varied uniformly from one shaft to the next.

The shaft for the 7 wood is the only shaft in which a portion of the shaft other than the variable stepped portion changed. The length of the butt portion for both the regular flex and the stiff flex 7 wood shafts was increased to 7.500 inches compared to 7.000 inches for the other shafts. The length of the variable stepped portion for the regular flex shaft was 2.000 inches and 3.000 inches for the stiff flex shafts, so the overall length of 41.500 inches for each shaft was the same as the length of the 6 wood shaft.

I have also found that the torsional rigidity and therefore the torque resistance of golf club shafts can be increased without increasing the weight of the shafts by increasing the outside and inside diameters of the shaft and decreasing the wall thickness. This is illustrated in FIGS. 6–9.

Figure 8:
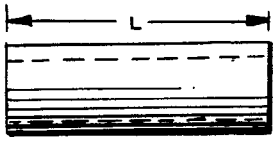
Figure 9:
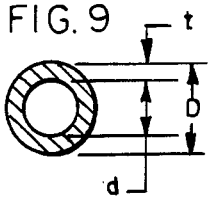

Shaft B illustrated in FIGS. 8 and 9 has a length L, an outside diameter D, an inside diameter d, and a thickness t. The weight in ounces of the shaft B is:

$$W=\pi/4(D^2-d^2)\times L\times 0.283\times 16 \text{ ounces}$$

If we assume that the length of Shaft B is 2 inches, the outside diameter is 0.5 inch, the inside diameter is 0.46 inch, and the thickness is 0.02 inch, then:

$$W=\pi/4[(0.5)^2-(0.46)^2]\times 2\times 0.283\times 16$$

$$W=0.27312 \text{ ounces}$$

Figure 6:
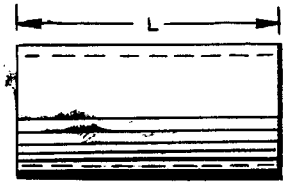
FIGS. 6 and 8 are elevational views of two shafts having the same weight but different inside and outside diameters and wall thicknesses.
Figure 7:
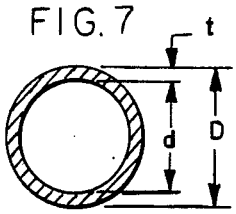
FIGS. 7 and 9 are end views of the shafts of FIGS. 6 and 8, respectively.

If we increase the outside diameter of the shaft to 0.65 inch as represented by Shaft A in FIGS. 6 and 7, the wall thickness must be decreased to 0.01512 inch in order to keep the weight of the same length of shaft at 0.27312 ounces. The dimensions of the two shafts are tabulated as follows:

| | D | d | t | L | $W_{(oz)}$ |
|---|---|---|---|---|---|
| Shaft B | .5" | .4600" | .0200" | 2" | .27312 |
| Shaft A | .65" | .6198" | .01512" | 2" | .27312 |

If a torque of 100 inch-pounds were applied to the two shafts, the angles of twist would be:

$$\theta = \frac{T\times L}{J\times G}$$

where

T=torque

L=shaft length

J=polar moment of inertia

G=shear modulus of elasticity, ($12\times 10^6$ PSI for steel)

The polar moment of inertia of the cross-section of a tubular shaft is:

$$J=\pi/32(D^4-d^4)$$

For Shaft B:

$$J_B=\pi/32[(0.5)^4-(0.46)^4]=0.0017402 \text{ in.}^4$$

For Shaft A:

$$J_A = \pi/32[(0.65)^4 - (0.6197)^4] = 0.0030369 \text{ in.}^4$$

The angle of twist of Shaft B is:

$$\theta_B = \frac{100 \times 2}{.0017402 \times 12 \times 10^6} = .00958 \text{ Radian}$$

The angle of twist of Shaft A is:

$$\theta_A = \frac{100 \times 2}{.0030369 \times 12 \times 10^6} = .00549 \text{ Radian}$$

Accordingly, Shaft A twists less than Shaft B by almost 43%.

Increasing the outside and inside diameters of the shaft and decreasing the thickness of the shaft provides a higher polar moment of inertia with no increase in weight. Such a shaft will twist less at impact on an off-center hit and will provide more accuracy and a higher stiffness.

In the preferred embodiment of the invention the tip portion, stepped portions, and butt portions of iron shafts which had the previously described outside diameters had the following wall thicknesses for stiff flex and regular flex shafts:

| | IRON SHAFTS | |
|---|---|---|
| Outside Diameter | S-Flex Wall Thickness | R-Flex Wall Thickness |
| .355 inch | .024 inch | .024 inch |
| .400 | .0197 | .0186 |
| .425 | .0190 | .0179 |
| .450 | .0183 | .0172 |
| .475 | .0176 | .0165 |
| .500 | .0169 | .0158 |
| .525 | .0162 | .0151 |
| .550 | .0155 | .0144 |
| .575 | .0148 | .0137 |
| .585 | .0145 | .0134 |
| .600 | .0138 | .0130 |

The outside diameters of 0.355 and 0.400 refer respectively, to the tip end 16 and the upper end of the tip portion. The outside diameter of 0.600 refers to the butt portion, and the intervening diameters refer to the various stepped portions 17–24 as previously described.

It will be seen that the wall thickness of the sections decreases with increasing outside diameter. The ratio of wall thickness to outside diameter for regular flex iron shafts varies from 0.068 at the tip end 16 to 0.0217 at the butt portion. The ratio of wall thickness to outside diameter for stiff flex iron shafts varies from 0.068 at the tip end to 0.023 for the butt portion.

The wall thickness for the various portions of stiff flex and regular flex shafts for wood clubs varied as follows:

| | WOOD SHAFTS | |
|---|---|---|
| Outside Diameter | S-Flex Wall Thickness | R-Flex Wall Thickness |
| .302 inch | .0206 inch | .0195 inch |
| .345 | .0194 | .0185 |
| .369 | .0184 | .0175 |
| .393 | .0181 | .0167 |
| .417 | .0177 | .0162 |

-continued

| | WOOD SHAFTS | |
|---|---|---|
| Outside Diameter | S-Flex Wall Thickness | R-Flex Wall Thickness |
| .441 | .0172 | .0157 |
| .465 | .0167 | .0153 |
| .489 | .0161 | .0150 |
| .513 | .0155 | .0147 |
| .537 | .0149 | .0143 |
| .561 | .0145 | .0137 |
| .585 | .0139 | .0133 |
| .600 | .0133 | .0127 |

The diameters of 0.302 and 0.345 refer to the top and bottom portions of the tapered tip portion. The diameter of 0.600 refers to the butt portion, and the intervening diameters refer to the ten stepped portions.

The wall thickness of the various portions of the shafts for wood clubs decreased with increasing outside diameter. The ratio of wall thickness to outside diameter for regular flex wood shafts varied from 0.065 at the tip end to 0.021 at the butt portion.

The foregoing outside diameters and wall thicknesses provide each of the various sized portions of the shaft with a high polar moment of inertia which provides substantial resistance to torque. It is believed that the shafts formed in accordance with the invention have substantially better torque resistance characteristics than prior clubs. The polar moments of inertia for the crosssections of the various portions of the iron shafts can be calculated from the foregoing formula for polar moment of inertia:

$$J = \pi/32(D^4 = d^4)$$

| | IRON SHAFTS | |
|---|---|---|
| Outside Diameter | S-Flex Polar Moment of Inertia | R-Flex Polar Moment of Inertia |
| .355 inch | .0006872 in.$^4$ | .0006872 in.$^4$ |
| .400 | .0008533 in.$^4$ | .0008124 in.$^4$ |
| .425 | .0010009 in.$^4$ | .0009504 in.$^4$ |
| .450 | .0011584 in.$^4$ | .0010969 in.$^4$ |
| .475 | .0013247 in.$^4$ | .0012507 in.$^4$ |
| .500 | .0014984 in.$^4$ | .0014102 in.$^4$ |
| .525 | .0016776 in.$^4$ | .0015736 in.$^4$ |
| .550 | .0018605 in.$^4$ | .0017390 in.$^4$ |
| .575 | .0020450 in.$^4$ | .0019039 in.$^4$ |
| .585 | .0021159 in.$^4$ | .0019666 in.$^4$ |
| .600 | .0021845 in.$^4$ | .0020661 in.$^4$ |

The polar moments of inertia for the various portions of the wood shafts formed in accordance with the invention are:

| | WOOD SHAFTS | |
|---|---|---|
| Outside Diameter | S-Flex Polar Moment of Inertia | R-Flex Polar Moment of Inertia |
| .302 inch | .0003625 in.$^4$ | .0003469 in.$^4$ |
| .345 | .0005278 in.$^4$ | .0005073 in.$^4$ |
| .369 | .0006245 in.$^4$ | .0005984 in.$^4$ |
| .393 | .0007508 in.$^4$ | .0007003 in.$^4$ |
| .417 | .0008868 in.$^4$ | .0008205 in.$^4$ |
| .441 | .0010299 in.$^4$ | .0009499 in.$^4$ |
| .465 | .0011834 in.$^4$ | .0010941 in.$^4$ |
| .489 | .0013388 in.$^4$ | .0012559 in.$^4$ |
| .513 | .0015500 in.$^4$ | .0014297 in.$^4$ |
| .537 | .0016668 in.$^4$ | .0016051 in.$^4$ |
| .561 | .0018601 in.$^4$ | .0017651 in.$^4$ |

-continued

| Outside Diameter | WOOD SHAFTS S-Flex Polar Moment of Inertia | R-Flex Polar Moment of Inertia |
|---|---|---|
| .585 | .0020347 in.$^4$ | .0019529 in.$^4$ |
| .600 | .0021106 in.$^4$ | .0020215 in.$^4$ |

The polar moment of inertia increases from the bottom of the shaft to the top of the shaft even though the wall thickness decreases from the bottom of the shaft to the top of the shaft. The ratio of wall thickness to polar moment of inertia for regular flex iron shafts varies from 28.38 at the tip end 16 to 6.15 at the butt portion. The ratio of wall thickness to polar moment of inertia for stiff flex iron shafts varies from 29.98 at the tip end to 6.09 at the butt end.

The increased polar moment of inertia of shafts formed in accordance with the invention is exemplified by the following comparison of the outside diameters, wall thicknesses, and polar moments of inertia at various distances from the tip ends of the shaft for a particular prior art shaft and a shaft made in accordance with the invention. Both shafts were 38 inches long and were regular flex.

| Inches From Tip | | Prior Art Shaft | Inventive Shaft |
|---|---|---|---|
| 12½ | Diameter | .395 | .450 |
| | Wall Thickness | .0211 | .0172 |
| | Polar Moment of Inertia | .0008690 | .0010969 |
| 20 | Diameter | .470 | .525 |
| | Wall Thickness | .0163 | .0151 |
| | Polar Moment of Inertia | .0011971 | .0015736 |
| 25 | Diameter | .515 | .575 |
| | Wall Thickness | .01622 | .0137 |
| | Polar Moment of Inertia | .0015829 | .0019039 |
| 30 | Diameter | .545 | .585 |
| | Wall Thickness | .01587 | .0134 |
| | Polar Moment of Inertia | .0018487 | .0019666 |

At any point spaced from the tip end, the inventive shaft has a higher polar moment of inertia and therefore more torque resistance. The ratios of wall thickness to outside diameter for the foregoing prior art shaft and the inventive regular shaft and the ratios of wall thickness to polar moment of inertia for the prior art shaft and the inventive regular flex shaft can be compared as follows:

| Inches From Tip | | Prior Art Shaft | Inventive Shaft |
|---|---|---|---|
| 12½ | Thickness / Outside Diameter | 0.05 | 0.04 |
| | Thickness / Polar Moment of Inertia | 24.28 | 15.68 |
| 20 | Thickness / Outside Diameter | 0.03 | 0.03 |
| | Thickness / Polar Moment of Inertia | 13.62 | 9.60 |
| 25 | Thickness / Outside Diameter | 0.03 | 0.02 |
| | Thickness / Polar Moment of Inertia | 10.24 | 7.20 |
| 30 | Thickness / Outside Diameter | .03 | 0.02 |

-continued

| Inches From Tip | | Prior Art Shaft | Inventive Shaft |
|---|---|---|---|
| | Thickness / Polar Moment of Inertia | 8.58 | 6.81 |

I have not compared the foregoing ratios of the inventive shaft with the ratios of all prior art shafts. However, I believe that shafts made in accordance with the invention have a higher polar moment of inertia at corresponding points along the shaft and have a higher polar moment of inertia for any given wall thickness. Accordingly, the ratio of thickness to polar moment of inertia for the inventive shaft will be less than the ratio of thickness to polar moment of inertia at the corresponding point of prior art shafts.

While in the foregoing specification a detailed description of specific embodiments of the invention was set forth for the purpose of illustration, it will be understood that many of the details herein given may be varied considerably by those skilled in the art without departing from the spirit and scope of the invention.

I claim:

1. A set of golf club shafts comprising a plurality of shafts, each shaft having a butt portion and a tip portion and a fixed number of stepped portions of decreasing diameter between the butt portion and the tip portion, the number of stepped portions of each shaft being the same for each shaft of the set, the length of the butt portion and the length of the tip portion being the same for each shaft of the set, the length of one of the stepped portions of each shaft being different for each shaft and the length of each of the other stepped portions of each shaft being the same as the length of the corresponding stepped portion of each of the other shafts, the overall length of each shaft being different for each shaft, the difference in overall length between any two shafts being the same as the difference in the lengths of said one stepped portion of the two shafts.

2. The set of claim 1 in which the inside and outside diameters of the butt portion of each shaft of the set are the same, the inside and outside diameters of the tip portion of each shaft of the set are the same, and the inside and outside diameters of each of the stepped portions of each shaft are the same as the inside and outside diameters of the corresponding stepped portion of each of the outer shafts.

3. The set of claim 1 in which the set includes a plurality of shafts for consecutive numbered clubs, the length of said one stepped portion of each of the shafts being selected so that the difference in the frequencies of vibration of consecutive numbered shafts is substantially constant.

4. The set of claim 1 in which said one stepped portion of each shaft is separated from the butt portion by at least one of said other stepped portions.

5. The set of claim 1 in which one of said other stepped portions is between the butt portion and said one stepped portion.

6. The set of claim 1 in which each of said other stepped portions of each shaft between said one stepped portion and the tip portion has the same length.

7. The set of claim 1 in which the ratio of wall thickness to outside diameter of said tip portion, stepped portions, and butt portion decreases for each successive portion from the tip portion to the butt portion from about 0.07 at the tip portion to about 0.02 at the butt portion.

8. The set of claim 1 in which the ratio of wall thickness to polar moment of inertia of said tip portion, stepped portions, and butt portion decreases for each successive portion from the tip portion to the butt portion from about 28.38 at the tip portion to about 6.15 at the butt portion.

* * * * *